US006930612B1

(12) United States Patent
Kraz et al.

(10) Patent No.: US 6,930,612 B1
(45) Date of Patent: Aug. 16, 2005

(54) DEVICE AND METHOD OF MONITORING GROUNDING OF PERSONNEL AND EQUIPMENT IN ESD-SENSITIVE AREAS

(75) Inventors: Vladimir Kraz, Santa Cruz, CA (US); Kirk Alan Martin, Aptos, CA (US)

(73) Assignee: Credence Technologies, Inc., Soquel, CA (US)

( * ) Notice: Subject to any disclaimer, the term of this patent is extended or adjusted under 35 U.S.C. 154(b) by 98 days.

(21) Appl. No.: 10/264,381

(22) Filed: Oct. 4, 2002

(51) Int. Cl.[7] ..... G08B 21/00

(52) U.S. Cl. ..... 340/649; 340/660; 340/664; 340/657; 340/652; 340/653; 340/650

(58) Field of Search ..... 340/649, 650, 340/651, 652, 653, 660, 664, 561, 661, 635, 657; 361/212

(56) References Cited

U.S. PATENT DOCUMENTS 3,961,319 A 6/1976 Asberry
4,558,309 A 12/1985 Antonevich
4,785,294 A * 11/1988 Campbell ..... 340/649
5,057,965 A * 10/1991 Wilson ..... 340/652
5,519,384 A * 5/1996 Chanudet et al. ..... 340/649
5,952,931 A * 9/1999 Chotichanon et al. ..... 340/649
6,035,260 A 3/2000 Pohribnij et al.
6,150,945 A * 11/2000 Wilson ..... 340/661

OTHER PUBLICATIONS

3M Model 724 Work Station Monitor Instructions, 21 pages.
Semtronics ZVM1002 Zero Volt Monitor, 2 pages.
Novx Corporation, Series 300 Workstation Monitor, User's Manual, San Jose, California, USA, Version 1.4, Jan. 6, 2000, 4 pages.

* cited by examiner

*Primary Examiner*—Jeffery Hofsass
*Assistant Examiner*—Daniel Prévil
(74) *Attorney, Agent, or Firm*—DLA Piper Rudnick Gray Cary US LLP

(57) ABSTRACT

A method and apparatus for monitoring grounding of personnel and equipment in electrostatic discharge (ESD) sensitive areas. The device generates a low voltage alternating current control signal (60) which is applied to personnel (50) and equipment (350) being monitored. The device further includes signal conditioning (66) and detection means (70) to distinguish static charges from the control signal and transmit an alarm (72) upon detection of such static charge. The method encompasses the use of an alternating current control signal to detect static charge.

62 Claims, 13 Drawing Sheets

| Figure 14A | Figure 14B | Figure 14C |
|---|---|---|

DEVICE AND METHOD OF MONITORING GROUNDING OF PERSONNEL AND EQUIPMENT IN ESD-SENSITIVE AREAS

TECHNICAL FIELD

This invention relates to workstation monitors. In particular, the invention relates to methods and apparatus for maintaining a safe electrostatic (ESD) discharged environment in critical situations, such as, in workstations and tools. With still greater particularity, the invention relates to wrist strap monitors that assure operators are properly connected to ground for dissipation of static electricity, and ground monitors for assurance of proper ground connection of equipment and static-dissipative surfaces.

BACKGROUND ART

There are several wrist strap monitor technologies presently on the market. The most used method for ESD-sensitive environments is dual wrist strap monitoring. A dual wrist strap consists of two conductive halves, which in use are electrically connected via a human body. The resistance of a human body indicates proper connection of the operator to the wrist strap. A wrist strap monitor requires a control signal in order to detect conductivity of human body. Existing wrist strap monitors use a control signal of high voltage (up to 12V). A voltage of this level, while safe for an operator, presents danger to the latest very sensitive components. Operators charged to such high voltage who touch sensitive components with their hands or other tool deliver a damaging discharge to the device.

In order to reduce operator's exposure to monitoring voltage, some existing wrist strap monitors utilize pulsed control signals where the control signal is present in the form of pulses. Such a solution leaves the operator without any monitoring for the duration of time between the pulses. This method reduces exposure time, but does not reduce peak voltage exposure present during the pulse.

An alternative method is to supply equal but opposite polarity voltages to the two halves of the wrist strap. The assumption being that the resulting voltage on operator would then be zero. This method fails when there is any difference in the quality of contact to human body by the two halves of the wrist strap or when one half of the wrist strap is damaged. In either case, a significant voltage on the operator may be present.

Another problem with all present schemes of dual wrist strap monitors is that if an operator is connected only to one half of the wrist strap, he or she may be exposed to a higher voltage than is present when a wrist strap is worn properly. This is because the presence of human body resistance is checked by either the voltage drop of the control signal across two halves of the wrist strap or by the leakage of control signal across human body (the wrist). When the circuit is closed, the voltage applied to human body can be marginally tolerable for non-critical applications. However, when the wrist strap is worn with a poor contact between at least one of its halves to human skin, the applied voltage on human body can be as high as 12V. Under this situation the wrist strap monitor that is supposed to assure ESD-free environment creates more exposure to sensitive components than no monitor at all.

DISCLOSURE OF THE INVENTION

As the requirements for ESD safety become more critical, requirements for workstation monitors increase.

Specifically, control voltage used for dual wrist strap monitors now must be very low. For some disk drive manufacturing applications the desired voltage on human body shouldn't exceed 0.5V and this number is expected to get even lower.

Other parameters that are often checked by workstation monitors are ground resistance of metal tools and fixtures or static-dissipative surfaces to ground. Existing ground monitors verify a proper connection to ground by checking its DC resistance. However, newest standards, such as ANSI/ESDA S.20.20 specifically require testing of AC impedance to ground. No consideration is given in existing devices to poor quality of grounding at high frequencies. The presence of high frequency signals on the ground may also cause equipment malfunction.

The invention provides a device and method of monitoring proper operator's connection to a dual wrist strap utilizing safe low voltage under any conditions, open or closed, as well as proper monitoring of ground connections of equipment.

To detect contact with human body, a signal with specific properties (control signal) is provided by the invention to one side of a dual wrist strap. When the circuit is open, i.e., wrist strap is open, the voltage between the two halves of the wrist strap is at its maximum. If human hand is in contact with both sides of the wrist strap, the human hand acts as a resistor in a voltage divider and the voltage across two halves of the wrist strap drops. The invention measures this voltage drop allowing detection of electrical contact with the human hand.

To minimize the voltage applied to a human body, differentiation between control signal and ambient signals is provided by the invention allowing the use of a low voltage control signal. In existing designs the control signal is either DC voltage or pulsed DC voltage. Since the static voltage generated by body movements is also DC and has similar properties, the DC control voltage required for reliable differentiation of connection to a human body must be fairly high. The device of the invention provides a control signal with distinctly different properties than are normally found in the work environment and thus allows reliable detection of connection to a human body using very low amplitude of the control signal. Specifically, a low-level AC signal with a frequency different from the AC mains frequency (i.e., 50 or 60 Hz) is provided.

MODES FOR CARRYING OUT THE INVENTION

Figure 1:
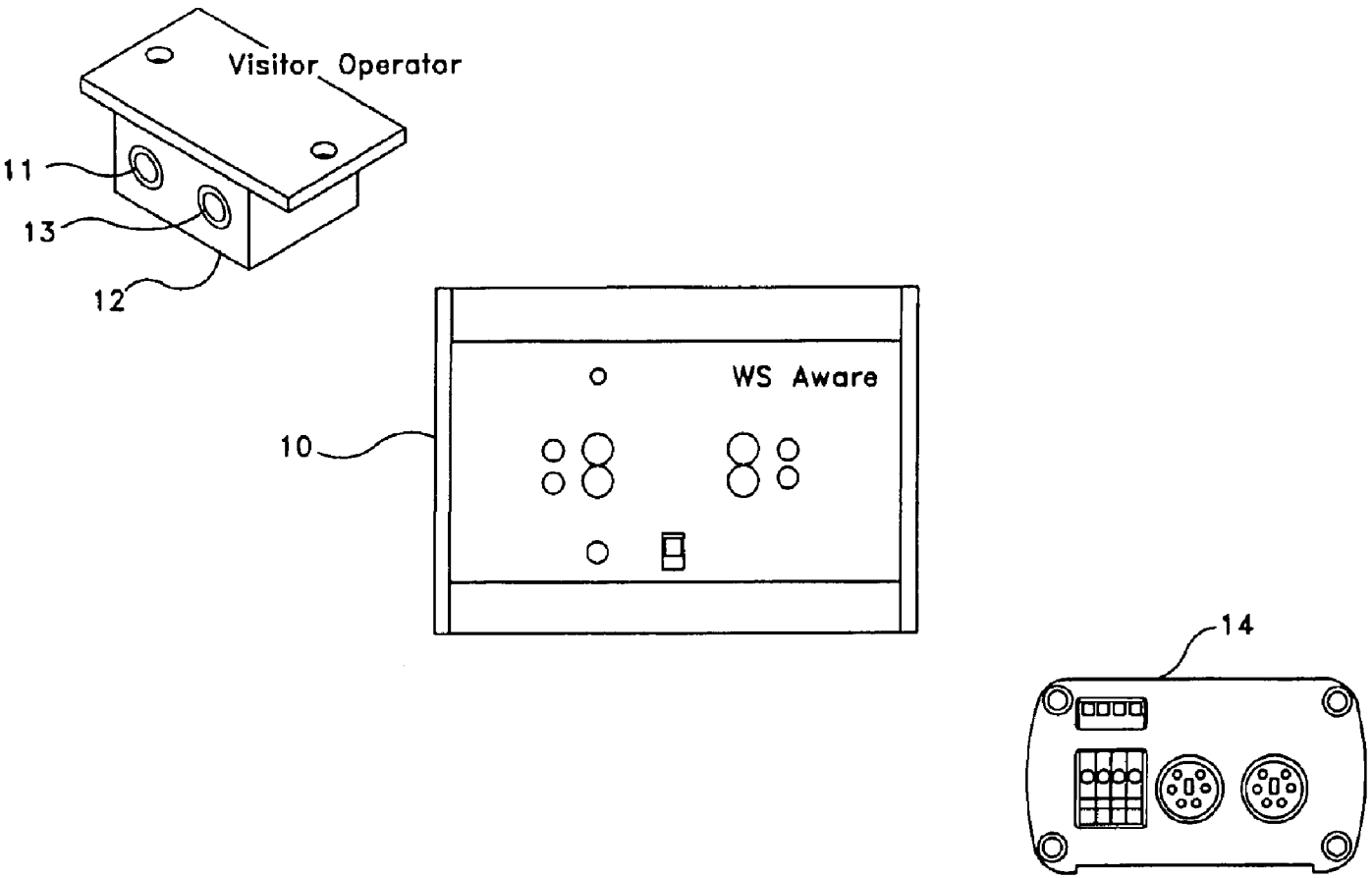
FIG. 1 is a diagram of a first embodiment of the invention.

FIG. 1 is a diagram of a first embodiment of the invention. Workstation monitor 10 provides monitoring of operators using remote terminal 12, having a jack 11 for a visitor and a jack 13 for an operator, which is connected to monitor 10 via cables (not shown). Monitor 10 also provides monitoring of two metal grounds and two dissipative or "soft" grounds. Cables to the wrist strap terminals and ground wires for monitoring are connectable to the left side 14 of monitor 10. Workstation monitor 10 is capable of monitoring two operators. For the purpose of disclosing operation of the proposed invention, only one channel, i.e., the channel for a single operator is described, as both channels are identical in the case of a double operator system.

Figure 2:
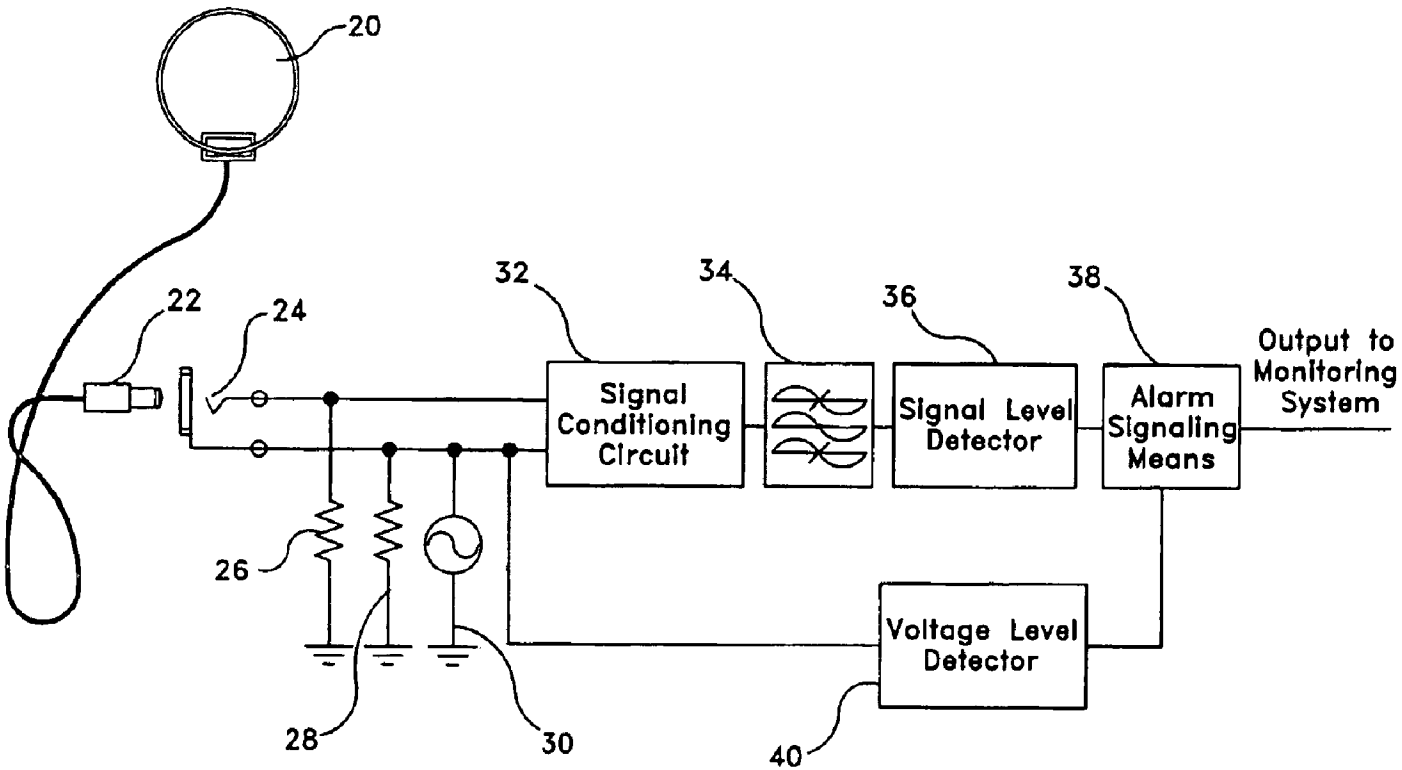
FIG. 2 is a block diagram of the FIG. 1 embodiment of the invention.

FIG. 2 is a block diagram of the FIG. 1 embodiment of the invention. A dual wrist strap 20 is connected via its plug 22 to the jack 24 of the monitor. One megohm (M) resistors 26 and 28 provide a safe electrically dissipative path to ground for both halves of the wrist strap. An oscillator 30 is connected to one half of the wrist strap. Oscillator 30 in this embodiment of the proposed invention has frequency of 20 Hz. It is desirable if the frequency chosen is not too close to the AC main frequency, i.e., 50 Hz or 60 Hz or their harmonics. Safety 1 (M) resistors (not shown) are normally built into the wrist straps. Their resistance, and resistors 26 and 28 combined with the resistance of the human body provide a voltage divider network. The resulting voltage across two halves of wrist strap 20 is the key indication of proper connection to an operator. When no operator is present, the resulting control voltage across the two terminals is relatively high. When a human body is present it closes the circuit between two halves of the wrists strap resulting in a relatively low voltage. A signal conditioning circuit 32 attached to jack 24 removes common-mode signals and provides partial filtering of the signal. A filter 34 attached to the output of signal conditioning circuit 32 removes unwanted signal components leaving only the desired control signal. A signal level detecting means 36 attached to the output of filter 34 issues an alarm signal to an alarm signaling means 38. Alarm signaling means 38 issues audio and/or visual alarms and is connectable signal to a facility monitoring or data acquisition system not (shown). The input of a body voltage detector 40 is connected to wrist strap 20, and the output of voltage detector 20 is connected to alarm signaling means 38.

One of the challenging tasks in measuring voltage on operator is presence of 50/60 Hz signal due to induced voltage from the power lines and equipment. In order to reduce 50/60 Hz signal conditioning circuit 32 may optionally include a common-mode rejection circuit. Because the wires in wrist strap 20 and the cable leading to it run close to supply lines. Due to the symmetry of the input circuit of the monitor, the induced 50/60 Hz voltage is essentially the same on both terminals of wrist strap 20. A common-mode rejection circuit provides substantial attenuation of the 50/60 Hz signal leaving the differential control signal intact. Bandpass filter 34 passes only the signals near the frequency of the control signal. Signal level detector 36 provides a signal to alarm-signaling means 38 when the voltage at the input of signal level detector 36 drops below a preset level. Alarm signaling 38 output can be in a form of LED, buzzer or any other acceptable means and/or also provide signalization to a facility monitoring system or to a data acquisition system. A voltage level detector 40 is employed to monitor the voltage on an operator. Voltage level detector 40 takes the voltage from either half of wrist strap 20 or from both of these halves and compares it with a preset reference signal and provides alarm signaling means 38 with the signal if the body voltage on operator exceeds the preset level.

Figure 3:
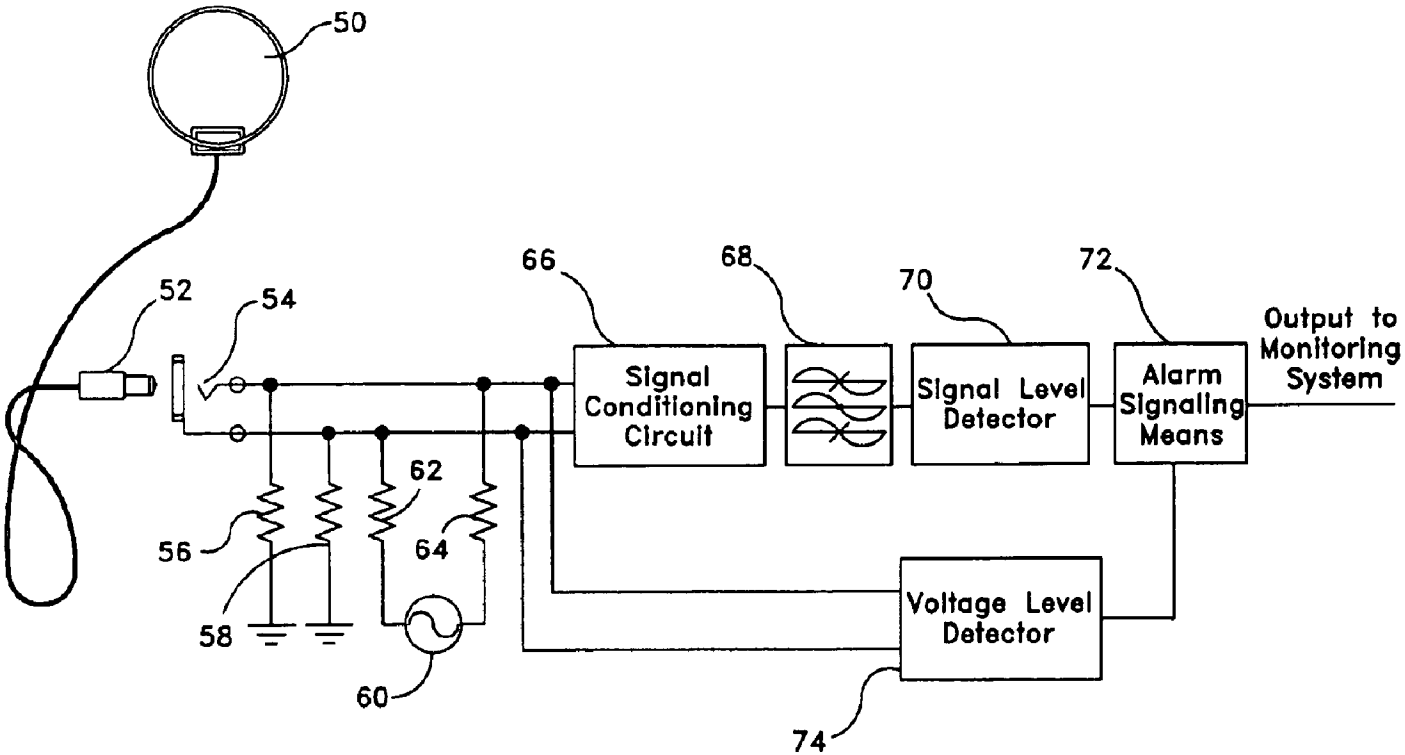
FIG. 3 is a block diagram of a second embodiment of the invention.

FIG. 3 is a block diagram of a second embodiment of the invention. The FIG. 3 embodiment is similar that of FIG. 2 but differs, in that, the signal oscillator 60 is connected symmetrically to both halves of the wrist strap 50 and the body voltage level detector 74 measures the voltage on both sides of wrist strap 50. Wrist strap 50 plugs via its plug 52 into the jack 54 of the monitor. Dual two (M) resistors 56 and 58 provide a safe path to ground. An oscillator 60 with symmetrical outputs provides opposite phase signals to both halves of the wrist strap via resistors 62 and 64. A signal conditioning circuit 66 helps to remove common-mode signals and provide partial filtering. A bandpass filter 68 removes unwanted signal components leaving only the desired control signal that is in turn passed to a signal level detecting means 70 that issues an alarm signal to alarm signaling means 72 when a static charge is detected. Alarm signaling means 72 issues audio and/or visual alarms and is connectable signal to a facility monitoring or data acquisition system not (shown). The two inputs of a body voltage detector 74 are connected to a wrist strap connector 50 and the output of voltage detector 74 is connected to alarm signaling means 72.

Figure 4:
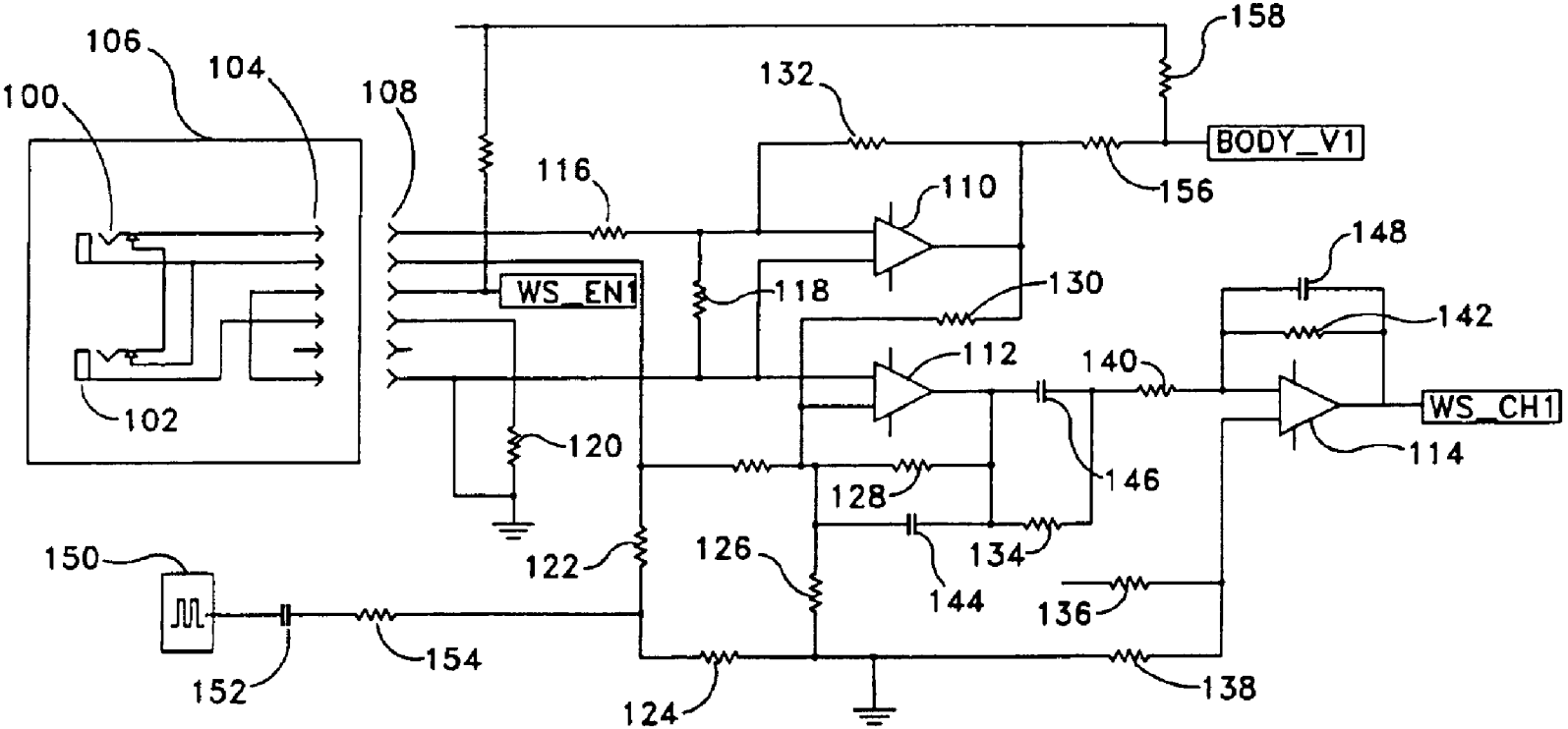
FIG. 4 is a schematic diagram of the signal conditioning circuit of the invention.

FIG. 4 is a schematic diagram of the signal condition circuit of the invention. The first jack 100 is for the operator and the second jack 102 is for a visitor 102. Jack 102 is typically used for visitors such as supervisors or other workers who approach the workbench and must wear ESD protection while being there. Jacks 100 and 102 are connected to a master jack 104 and are enclosed in the terminal box 106. Terminal box 106 is connected via cable (not shown) to the input jack 108 in the device monitor. A control signal is generated by an oscillator 150. A suitable control signal is a 20 Hz 5 volt p-p square wave. The frequency is preferably lower than the AC mains frequency, though it doesn't have to be in order to operate. This control signal can be generated by a microprocessor or by any other means. The control signal passes via DC blocking capacitor 152 typically 0.1 uf via a voltage divider comprised of a 100k resistor 154 and 2K resistor 124. After passing through 2 (M), resistor 122 the control signal reaches one half of the wrist strap via jack 108. A dissipative path to ground for the wrist strap is provided by 1 (M) resistor 116, 100K resistor 118, 1 (M) resistor 120, 122, 124 and 400K resistor 126. A signal-conditioning amplifier is built on op-amps 110, 112 and 114; resistors 116, 118, 120, 122, 124, 126, 128, 130, 132, 134, 136, 138, 140 and 142; capacitors 144, 146 and 148. A 3300 pf capacitor 148 in conjunction with a 2 (M) resistor 142 produces a 24 Hz. roll off in conjunction with op-amp 114 as do similar values for 144 and 128. If 146 is a 0.1 uf capacitor and 140 is a 200K resistor the device provides a 8 Hz high pass characteristic. The system thus produces a AC differential gain of 10 and a gain of 0 in the AC common mode. All components are provided with suitable supply voltages.

Capacitor 152 blocks DC content of the control signal and makes it symmetrical AC-only signal. Resistors 154 and 124 form a voltage divider that attenuates control signal to the level necessary for proper operation of device. It is highly desirable to reduce the control voltage on the human body as much as possible, while preserving the capability to reliably detect proper body connection. The particular embodiment reduces the control signal to 25 mV zero-to peak amplitude, which is at least an order of magnitude lower than in any existing monitor. The control voltage is provided via resistor 122 to the one half of the wrist strap. A common-mode rejection amplifier built on operational amplifiers 110 and 112 provides on the output of opamp 112 an indication of the differential voltage across the wrist strap while rejecting common mode voltage present equally on both halves of the wrist strap. Common-mode signal on a wrist strap typically includes 50/60 Hz-induced signals from the AC mains, various EMI-caused signals and DC static voltage created by body movements. Capacitor 144 and resistor 128 provide further attenuation of 50/60 Hz signal by forming a low-pass filter on opamp 112 with the cutoff frequency below the frequency of the mains. Opamp 114 provides amplification of differential signal from the output of the previous stage of opamp 112. Capacitor 146 blocks the DC voltage generated by body movements. High-value resistor 134 provides DC bias for opamp 114. Resistor 142 and capacitor 148 provide further filtering against 50/60 Hz signal. The output voltage of opamp 112 has physical range of +/−5V. Resistors 136 and 138 provide proper bias of the opamp 114 so that the output voltage in absence of any signal is ½ of the supply voltage. Output of opamp 110 contains DC signal, which is representative of a body voltage generated during body movements. The output voltage of opamp 110 has physical range of +/−5V. Resistors 156 and 158 convert this voltage range to 0 . . . 5V which can be then directly provided to A/D converter. When no operator is present, the control voltage across the wrist strap and at the output of signal level detecting means 26 FIG. 2 embodiment or 70 FIG. 3 embodiment is at the highest level. When an operator is present, the voltage drops since the body resistance of an operator participated in the voltage divider described above. When terminals of a wrist strap are shorted, the voltage is at the lowest level. This difference in voltage allows differentiating between those states. When the wrist strap is not plugged in, switching jack 100 is shorted and the control voltage across the terminals is at the lowest level. This serves as an indication that no wrist strap is present. When a visitor plugs his wrist strap into jack 102 while no operator wrist strap is present, the secondary contact jack 102 will open the wrist strap circuit, which will create a voltage equal to failure of the wrist strap. The end result is indication of a failure when only visitor jack is used. This is done to prevent operators from using visitor's jack for grounding instead of operator's jack since it will not be monitored.

Figure 5:
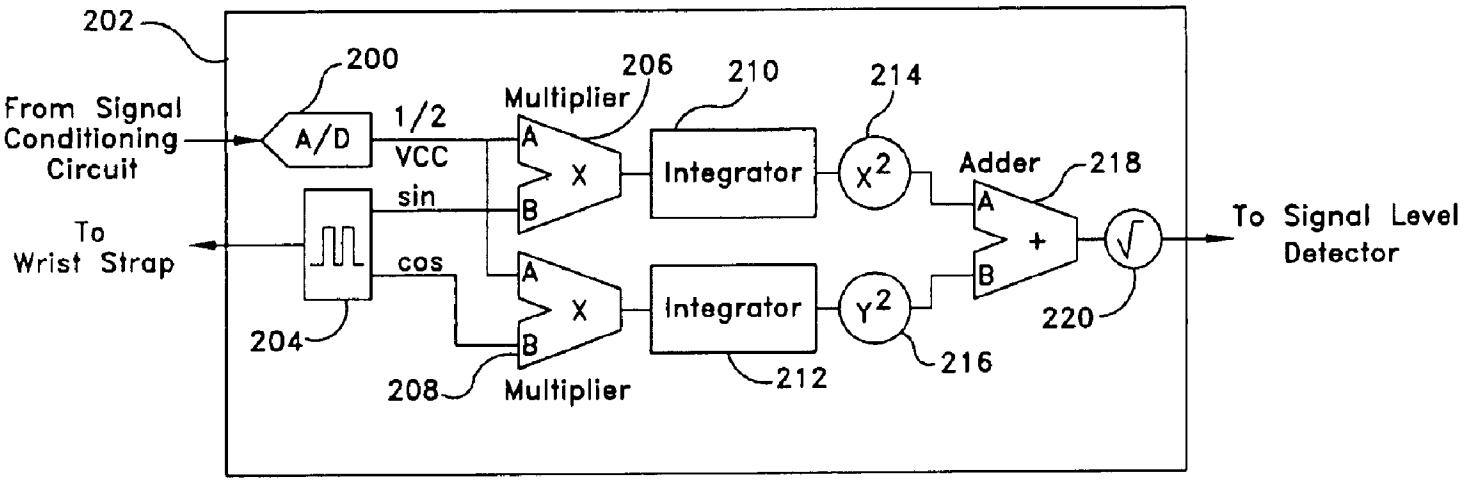
FIG. 5 is a schematic diagram of the filter circuit of the invention.

FIG. 5 is a schematic diagram of the filter circuit of this embodiment of the invention. It should be mentioned that many types of filtering would work within constraints of the proposed invention. Signal from the signal conditioning circuit shown in FIG. 4 is conveyed to the input of the A/D converter 200, which can be internal to a microprocessor 202. An oscillator 204 described before as reference numeral 30 in FIG. 2 may also be internal to microprocessor 202. The output of oscillator 202 with sinusoidal phase is connected to the first input of a multiplier 206. The second input of multiplier 206 is connected to the output of A/D converter 200. The second output of oscillator 204 with cosinusoidal phase is connected to the first input of a multiplier 208. The second input of multiplier 208 is also connected to the output of A/D converter 200. The outputs of multipliers 206 and 208 are connected to the inputs of respective integrators 210 and 212. The outputs of integrators 210 and 210 are connected to respective inputs of square functional blocks 214 and 216 respectively. The outputs of square functional blocks 214 and 216 are connected to the first and second inputs of an adder 218. The output of adder 218 is connected to the input of a square-root functional block 220.

Figure 6:
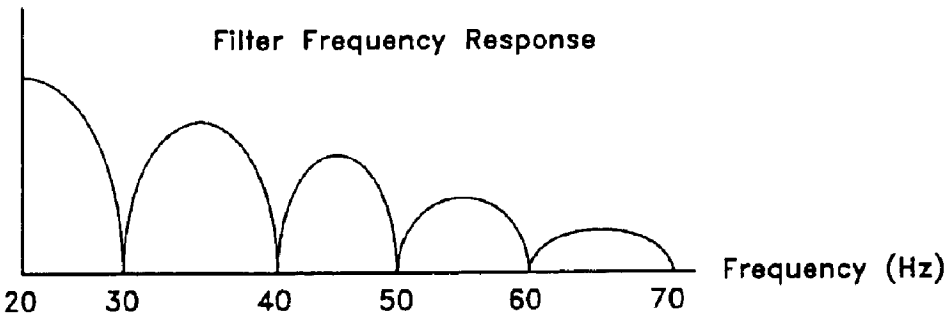
FIG. 6 is diagram of the response of the filter circuit of the invention.

Both sinusoidal and cosinusoidal phases of the signals are needed is because there is an unpredictable phase shift of the signal across the wrist strap due to capacitive coupling to the ground between the operator and the ground and between cables and ground. Each multiplier/integrator branch provides low-pass filtering with the response shown in FIG. 6. Specifically, this filter is designed so that the nulls on the frequency response fall on the frequency of AC mains (50 and 60 Hz). Such attenuation of the AC mains-induced signals allows use of a low-magnitude control signal. Summing of two filtered signals based on sinus and cosinus of the control signals eliminates uncertain phase shift of the signal across the terminal of the wrist strap.

The algorithm can be illustrated by the following formulae:

$$\mathrm{Sin}(N) = \sin\left(\frac{\pi N}{64}\right)$$

$$\mathrm{Cos}(N) = \cos\left(\frac{\pi N}{64}\right)$$

$$X = \sum_{N=0}^{N=255} \sin(N) * Value(N)$$

$$Y = \sum_{N=0}^{N=255} \cos(N) * Value(N)$$

Magnitude:

$$Vdc = \frac{\sum_{N=0}^{N=255} Value(N)}{256}$$

DC bias which represents the DC voltage on the wrist strap:

$$M = \sqrt{X^2 + Y^2}$$

Figure 7:
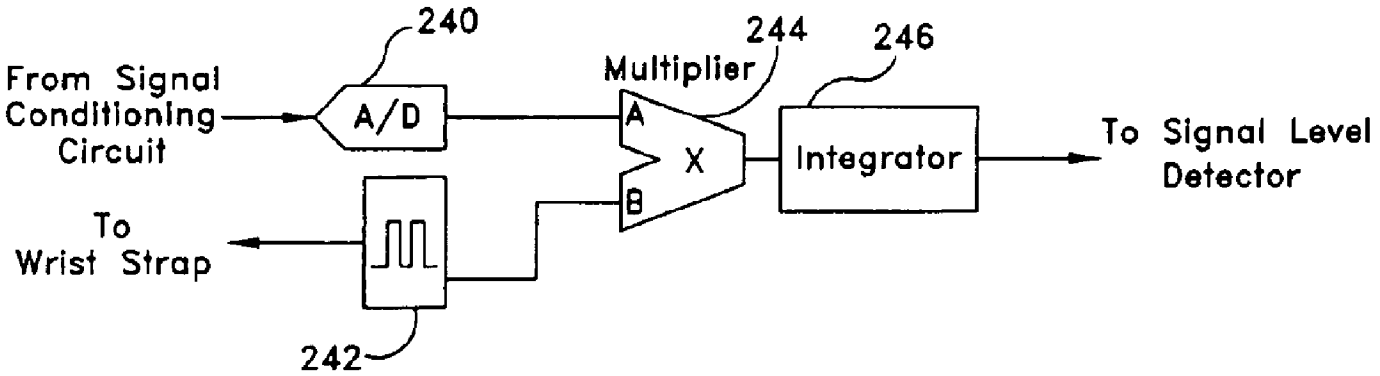
FIG. 7 is a schematic diagram of an alternative filter circuit of the invention.

FIG. 7 is a schematic diagram of an alternative filter circuit of the invention for the FIG. 3 embodiment. In that case the phase of the signal is always known and one of the branches of the filter becomes unnecessary. The diagram of such solution is presented in FIG. 7. In FIG. 7, A/D converter 240 and oscillator 242 are connected to multiplier 244, the output of which is connected to an integrator 246. Though the described embodiment teaches use of low-pass filter, a band-pass filter can be used within the constraints of the proposed invention. It is not unusual for an operator to develop substantial DC voltage as a result of movement and friction. Though this voltage would quickly dissipate via the wrist strap connection to ground, this voltage can drive the input stage of the monitor to saturation and cause an undetermined situation where the input signal is clipped to either rail and no control signal can be detected. To provide monitoring in this condition, the device uses an algorithm that concludes that if there is a DC voltage present at the input, an operator must be present since this is the only anticipated reason for the DC voltage to be present at the input. Therefore, if a DC voltage is present at the input, a "good connection" condition is displayed. At the same time, the body voltage detector would indicate excessive body voltage should it exceed preset threshold.

Figure 8:
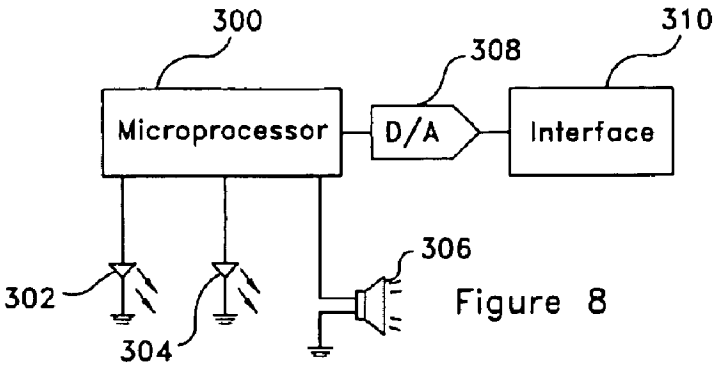
FIG. 8 is a schematic diagram of the output circuit of the invention.

FIG. 8 is a schematic diagram of the output circuit of the invention. Microprocessor 300 makes a determination whether the operator is present then either issues alarm using LED 302 or lights an "OK" LED 304 when wrist strap is worn properly. Microprocessor 300 also sounds buzzer 306 when there is a failure condition of poorly connected or absent operator. When no operator is present and no wrist strap is plugged in, no LED is lit. The output of microprocessor 300 is connected to an input of a D/A converter 308. D/A converter 308 may be a discrete device or internal to microprocessor 300. The output of D/A converter 308 is connected to an interface 310 that connects monitor to a facility monitoring system. This embodiment is capable of providing intelligent output to a facility monitoring system with indication of each state of operation. A user of this embodiment is capable of determining what is happening from the data provided by the facility monitoring system. Specifically, this embodiment of the proposed invention outputs different voltage (or current) levels corresponding to pre-determined states of the monitor.

Figure 9:
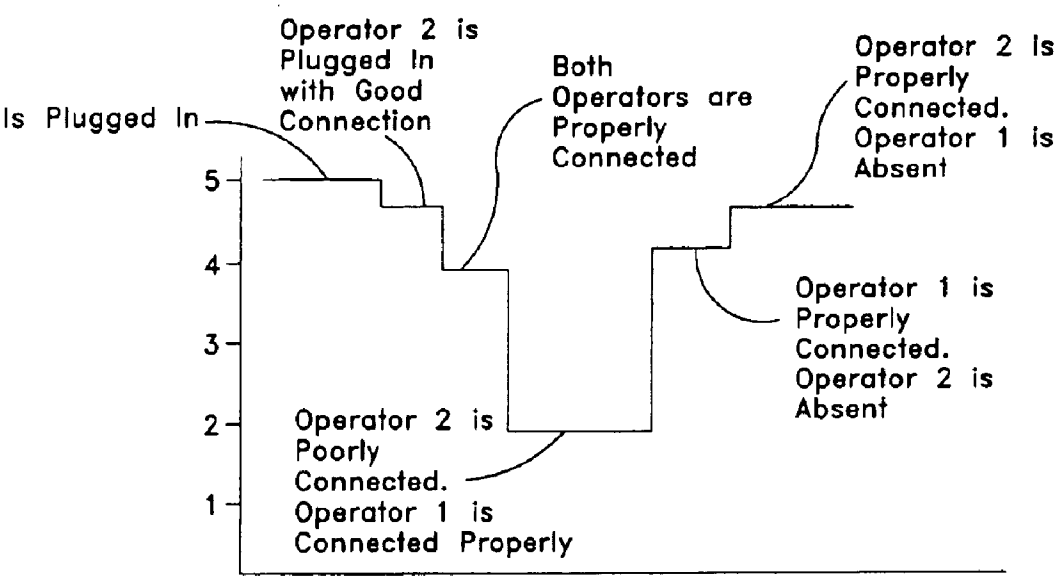
FIG. 9 is diagram of the output states of the output circuit of the invention.

FIG. 9 is a diagram of the output states of the output circuit of the invention. If the device is plugged in the output circuit outputs a 5 volt signal. This signal decreases to 4.5 volts if operator 2 is plugged in with a good connection and 4 volts if both operators are so connected. If operator 2 is poorly connected and operator 1 is properly connected the voltage drops to 2 volts indicating that something is amiss. This signal increases to 4.5 volts if operator 1 is plugged in with a good connection and operator 2 is absent. If operator 1 is absent and operator 2 is properly connected, the voltage is 4.5 volts. The output can also be (M) digital form providing proper codes corresponding to each operating state. Though the an embodiment described above shows only one monitoring channel of the wrist straps, two or more monitoring channels can be incorporated within constraints of the proposed invention.

Figure 10:
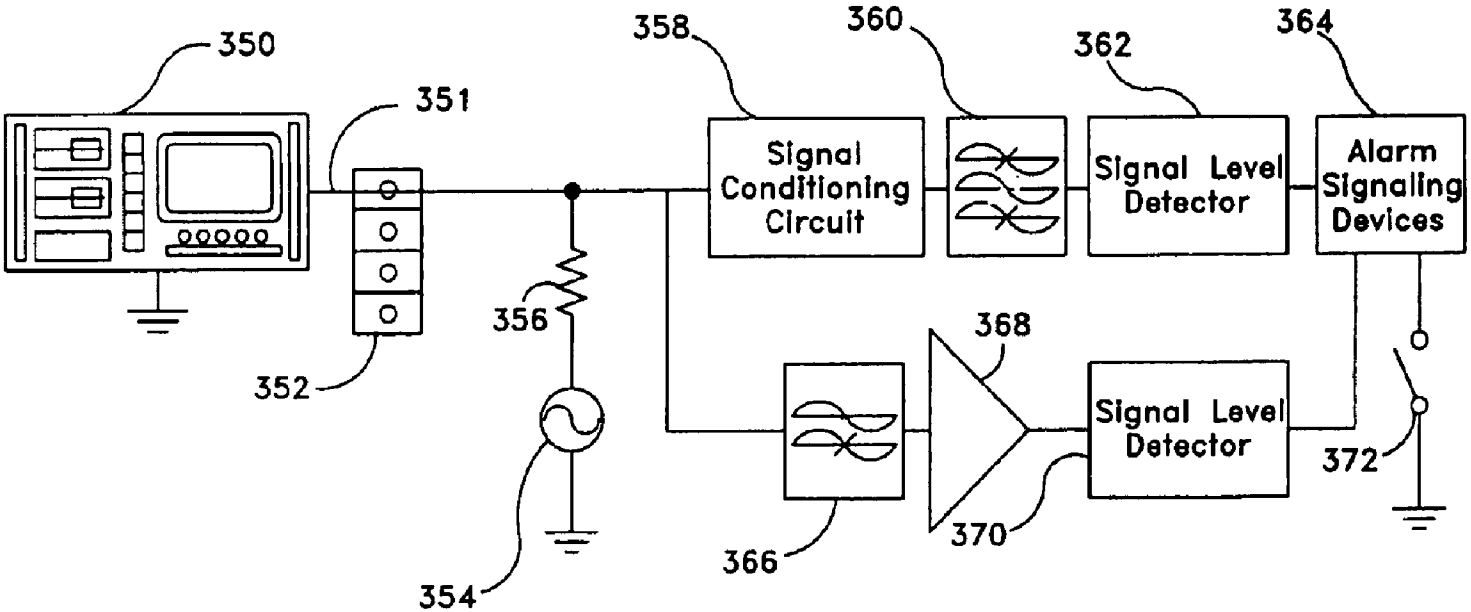
FIG. 10 is diagram of the ground monitoring system of the invention.

FIG. 10 is a diagram of the ground monitoring system of the invention. The ground of monitored equipment 350, which is grounded otherwise, is connected to a terminal 352 of the monitor with wire 351. An oscillator 354 generates a control signal which is connected to terminal 352 via resistor 356. In absence of connection between monitored equipment 350 and ground, the circuit is open and the control voltage on terminal 352 is at the highest level. When monitored equipment 350 is connected to ground, the circuit closes and the voltage of the control signal at terminal 352 drops. By measuring this voltage drop, it is possible to assess the impedance of ground connection of monitored equipment. Some industry standards, such as ANSI/ESD S.20.20 specify measurement of AC impedance to ground, rather than DC resistance.

The ground monitored control signal passes via an optional signal conditioning circuit 358 that removes extraneous signals and then a filter 360 that allows only the signal with the frequency of the control signal to pass. This signal is then analyzed by a signal detector circuit 362, which sends an alarm signal to the alarm signaling means 364 when the control voltage exceeds the preset level. The preset level can be set via setting in memory, by control potentiometer or switches. Alarm means 364 generates audio and visual alarms per user's requirements.

It is also possible within constraints of this embodiment to provide actual readings of ground connection impedance on any conventional display means or via interface to a facility monitoring system. Often, ground signal is polluted with high levels of electromagnetic interference, which negatively influences operation of equipment. The FIG. 10 circuit allows detection of excessive levels of EMI on ground. A high-pass filter 366 rejects low-frequency signals deemed to be outside of range of interest. An optional amplifier 368 boosts signal to levels necessary for detection. A signal level detector 370 provides said alarm means a signal when EMI level exceeds pre-determined value. This predetermined value level can be set via setting in memory, by control potentiometer or switches. It is also possible within constraints of proposed invention to provide actual readings of ground EMI levels on any conventional display means or via interface to a facility monitoring system.

The FIG. 10 circuit has an enabling switch 372 for each monitored ground connection. Should the user decide not to monitor a specific connection, he or she would put switch 372 in "Off" position. The monitor would then disable the signal light for the appropriate ground connection. If the connection is monitored and switch 372 is set to "On" position, the signal light would light green if the ground connection is good and red if it is failing. This way the user always knows the status of monitored ground and there is no ambiguity or false readings.

Figure 11:
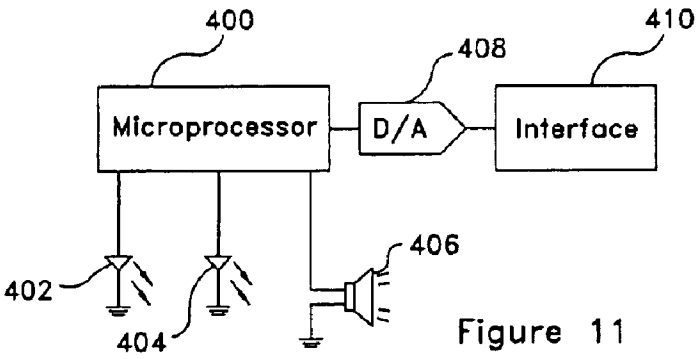
FIG. 11 is schematic diagram of the ground monitoring circuit of the invention.

FIG. 11 is schematic diagram of the ground monitoring circuit of the invention. Microprocessor 400 makes a determination whether the ground impedance fails, issues an alarm using LED 402 or lights an "OK" LED 404 when ground impedance is within norm or sounds buzzer 406 when there is a failure condition of poorly connected or absent equipment. When no ground monitoring is enabled on a particular channel, no LED is lit. Output of microprocessor 400 is connected to an input of a D/A converter 408 that could also be internal to said microprocessor. Output of D/A converter 408 is connected to an interface 410 that connects monitor to a facility monitoring system. The FIG. 11 circuit is capable of providing intelligent output to a facility monitoring system with indication of each state of ground. This way a user of a facility monitoring system is capable of determining what is happening from the data provided by the facility monitoring system. Specifically, this embodiment of outputs different voltage (or current) levels corresponding to pre-determined states of the monitor.

Figure 12:
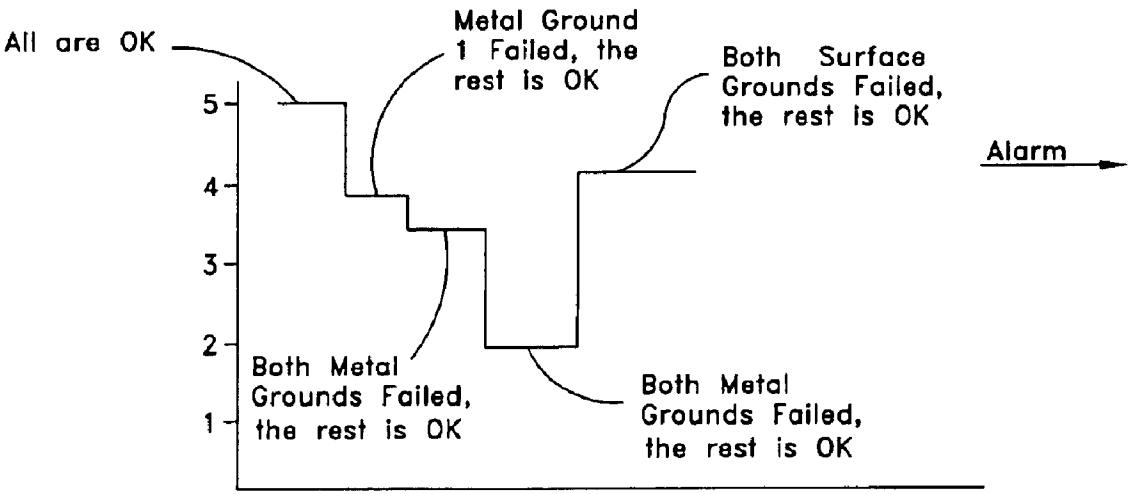
FIG. 12 is diagram of the output states of the ground monitoring circuit of the invention.

FIG. 12 is diagram of the output states of the ground monitoring circuit of the invention. If all grounds are OK the circuit outputs a 5 volt signal. This signal decreases to 3.5 volts if metal ground 1 failed and the remaining grounds are OK. If both metal grounds fail the voltage drops to 3 or 2 volts indicating a problem. Similarly, if both surface grounds fail, the voltage drops to 4.0. The output can also be digital providing proper codes corresponding to each operating state. In the FIG. 12 embodiment of the proposed invention, the switch for each monitored ground is connected to a port of a microprocessor that manages the operation of the monitor. However, other connections are possible, such as connecting said switch in series with signaling means for each monitored ground.

Figure 13:
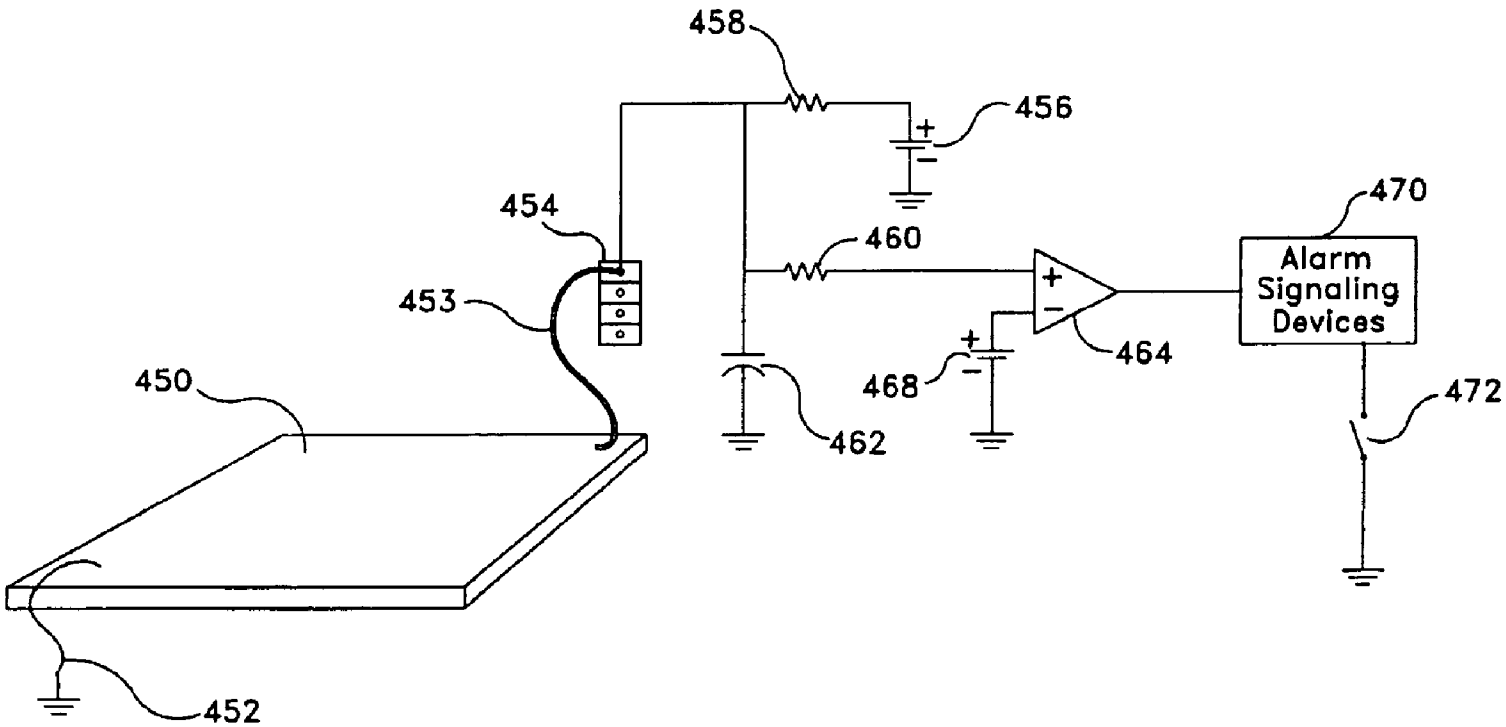
FIG. 13 is schematic diagram of the grounding circuit of the invention.

FIG. 13 is schematic diagram of the grounding circuit of the invention. Monitoring of static-dissipative ground is done using this circuit. High resistance of dissipative surface (in order of several hundred (M) makes it impossible to use the same approach as for the metal ground described above. A static-dissipative mat 450 is grounded via wire 452. Wire 453 from the mat is connected to a terminal 454. A DC control voltage from the power supply 456 is supplied to dissipative surface 450 via resistor 458. If the ground connection 452 is absent, the voltage at dissipative surface 450 is high. When ground connection 452 is present, the voltage drops due to resistance from the surface to ground. Capacitor 462 filters AC signals induced from the mains. A protective resistor 460 connects mat 450 with the first input of a comparator 464. The second input of comparator 464 is connected to a reference voltage source 468. Comparator 464 compares voltage on dissipative surface 450 with the reference voltage and if the voltage on dissipative surface 450 drops, the output of comparator 464 generates an alarm signal that is passed to the alarm signaling means 470. Alarm signaling means 470 is similar to those described in the above section related to monitoring metal ground. An enable switch is provided 472 for each static-dissipative ground monitored. Should the user decide not to monitor a specific static-dissipative ground, he or she would put switch 472 in "Off" position. The monitor would then disable signal light for the appropriate ground connection. If the static-dissipative ground is monitored and switch 472 is set to "On" position, the signal light would light green if the static-dissipative ground is good and red if it is failing. This way the user always knows the status of monitored static-dissipative ground and there is no ambiguity or false readings.

It is important to perform time-to-time calibration of the monitor. The embodiment shown has built-in capability to calibrate itself when a proper load is presented to its terminals. In order for the device to perform self-calibration, appropriate simulation load resistors must be connected to the wrist strap terminals instead of the wrist straps and the load resistors instead of ground connections. Then a command is issued to the monitor to perform self-calibration. Such command can be issued either locally by local controls, i.e., switch, or from a computer or other external device via appropriate interface, such as serial port or other. The monitor then would adjust its alarm thresholds in accordance with the presented references. At the end of self-calibration it is beneficial to issue a conformation, such as audio indication or confirmation to a computer is a computer initiates such calibration. To further the calibration process and proper record-keeping, a serial number of calibrated monitor and its calibration results can be then automatically stored in the computer initiating self-calibration.

Figure 14:
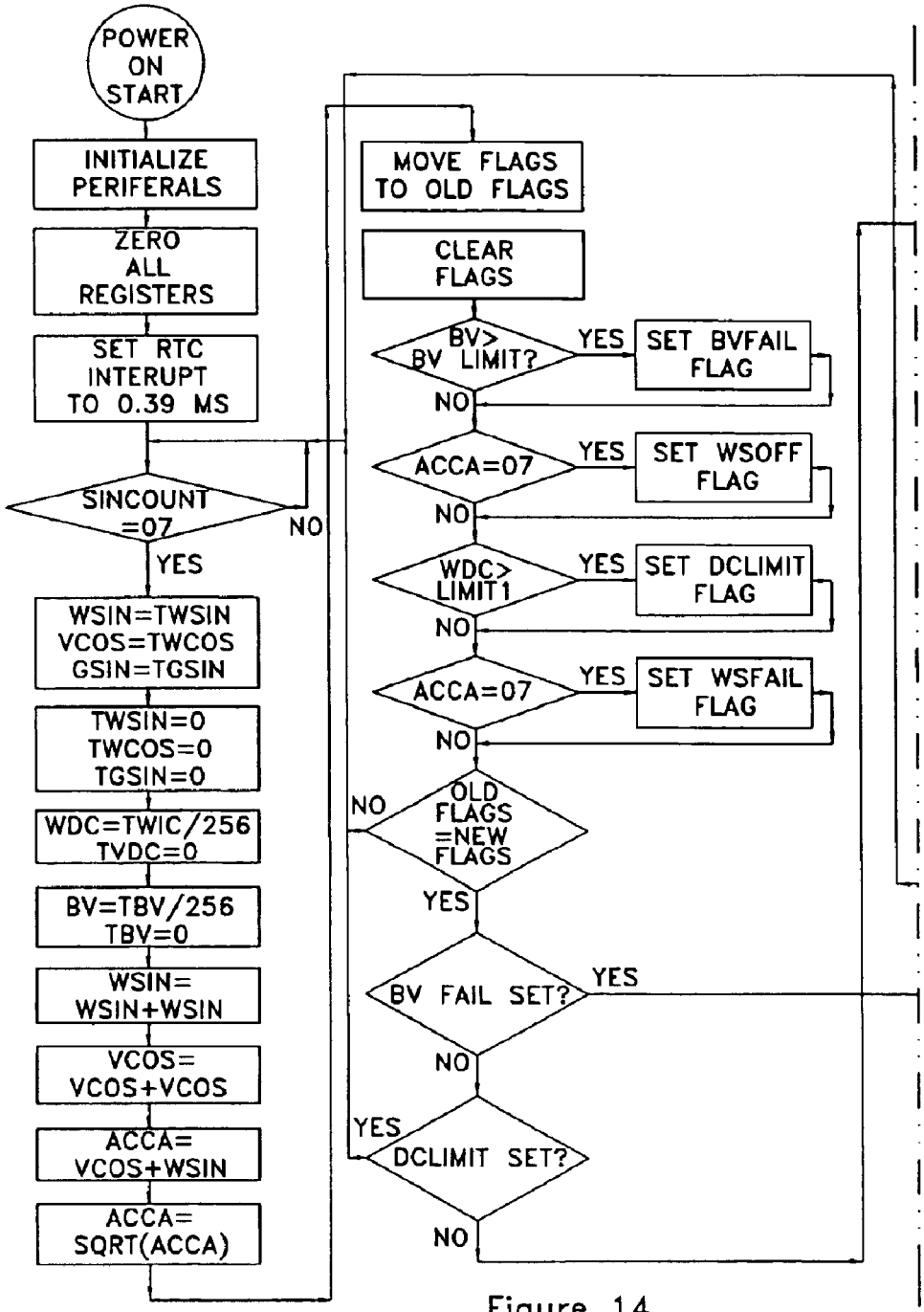
FIGS. 14A, 14B, and 14C illustrate a flow chart of the software of the invention.
Figure 14B:
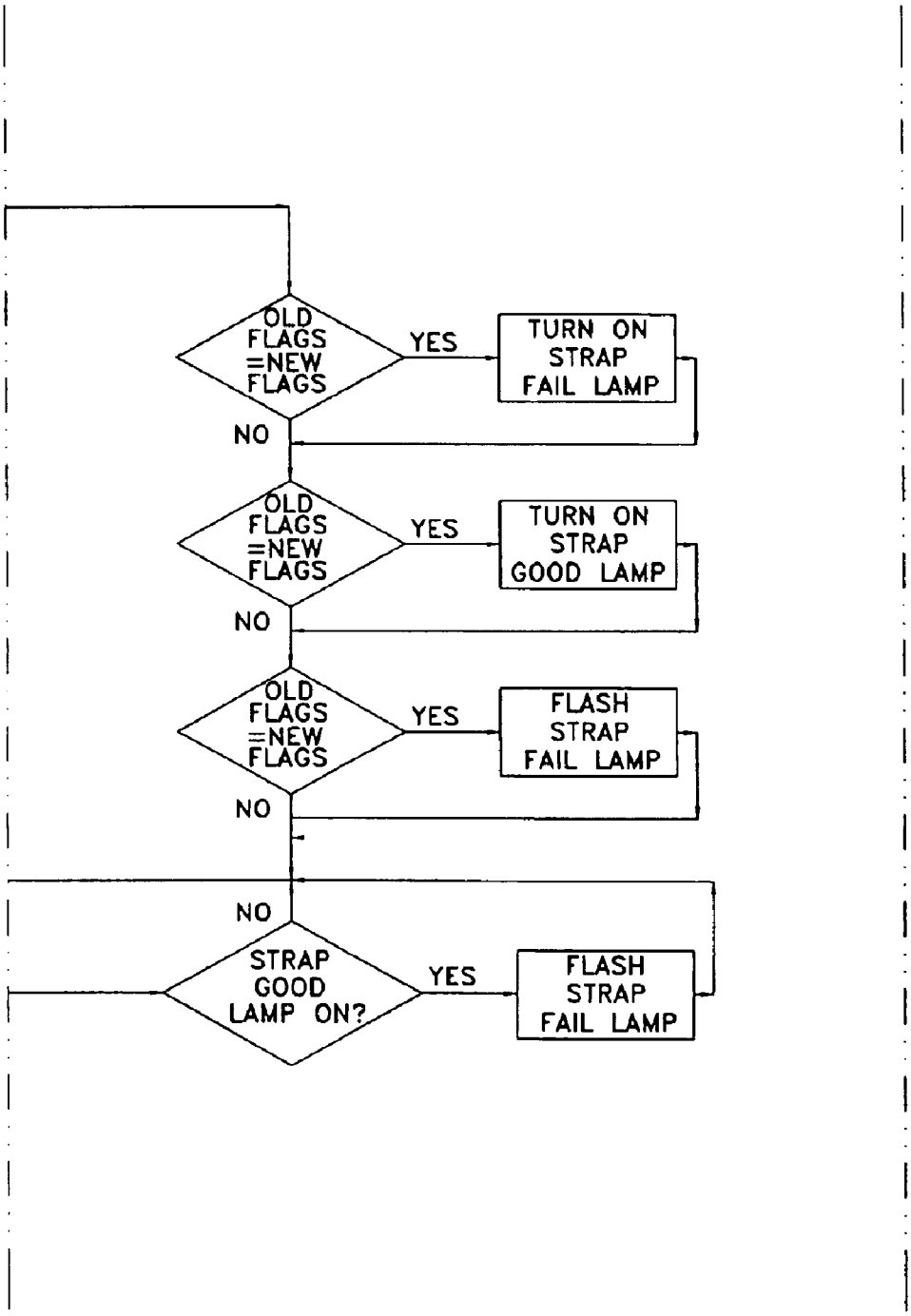
Figure 14C:
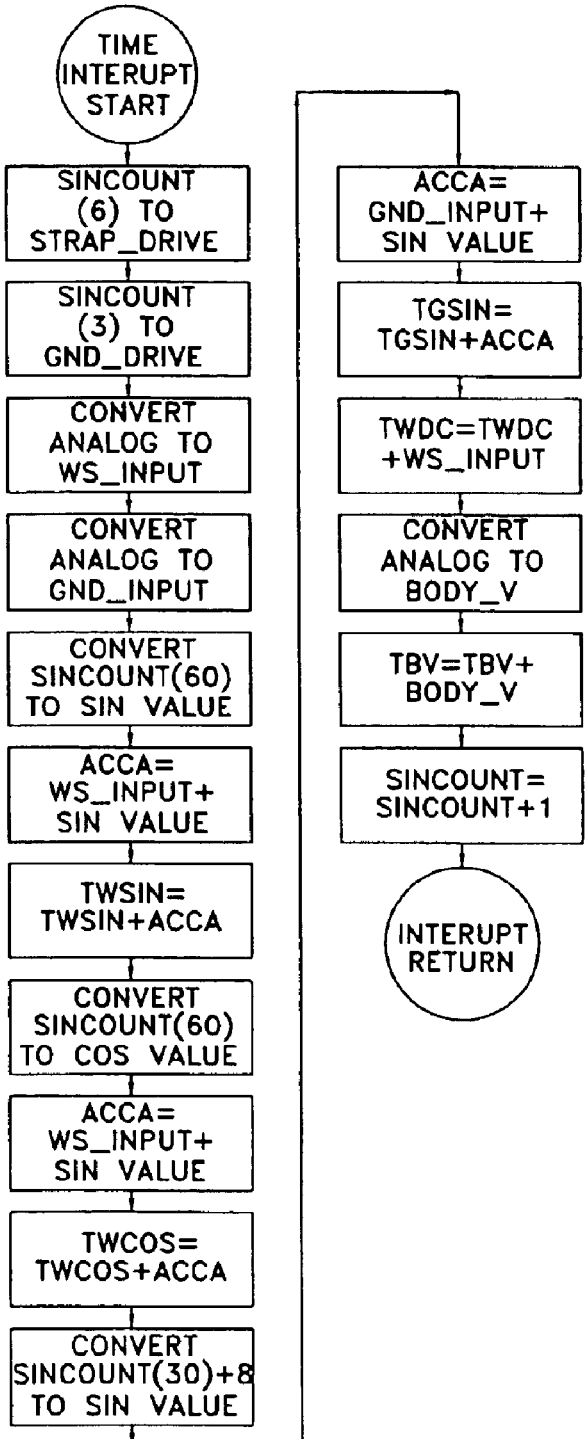

FIGS. 14A, 14B, and 14C illustrate a flow chart of the software of the invention. There are two flows, the main program that is interrupted every 0.39 milliseconds, and the interrupt service flow. The interrupt service routine measures the current voltage on the wrist strap (WS_CH1 in FIG. 4), ground, and body voltage (BODY_V1 in FIG. 4) signals. This conversion is done on a 10 bit A/D converter internal to the microcontroller. It also generates the drive signals to both the wrist strap circuit and the ground monitoring circuit. The reference for both of the drive signals are specific bits in the 8 bit register, SINCOUNT. This register is incremented every pass through the interrupt service routine and rolls over from 255 to 0. The drive to the wrist strap is a 20 Hz square wave and the ground drive is a 160 Hz square wave. Sine and cosine values are generated from the number in SINCOUNT through a lookup table. This performs the first two equations shown in the disclosure. The interrupt routine performs all of the multiplication and summation as shown in the equations above. The interrupt routine itself does not terminate the summations. It also integrates the body voltage value to eliminate systemic noise. The routine also performs other housekeeping tasks that are not important to the method of the invention. The main program on power up initializes all registers, I/O ports, etc., as is generally required in a microcontroller. There is then a loop which waits for SINCOUNT to equal 0. When this happens, the interrupt service has been accessed 256 times and all summations are complete. The data from the summation registers are transferred to a series of working registers and the summation registers are cleared making them ready for the next 256 passes through the interrupt routine. The data is transferred to the working registers so that the remainder of the main program will not interfere with the interrupt functions. The sine and cosine summations from the wrist strap are processed to generate a magnitude value that is independent from phase. The resultant data is processed to determine if the wrist strap is plugged in and worn properly. The magnitude is zero is no wrist strap is plugged in as the jack shorts the signals. If the wrist strap is not worn, the magnitude is at a maximum and the magnitude decreases if the strap is worn. The actual magnitude is inversely proportional to the resistance of the operator. Limits for the operator resistance, body voltage, and wrist strap DC bias are all preprogrammed based on the performance of each unit and the customer's requirements. Actual determination of the wrist strap state will not be determined until two sequential measurement cycles have the same state and there is no body or DC bias voltages present. This eliminates any transient false state detection. The lamps referred to are the LED indicators on the front panel of the unit.

INDUSTRIAL APPLICABILITY

The present invention finds industrial applicability in disk drive assembly, GMR head handling, semiconductor fabrication, reticle handling, laser diodes and fiber optics, electronic assembly, industrial robotics, medical and military applications and generally wherever electro-static discharge (ESD) is an issue.

SCOPE OF THE INVENTION

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims, in which reference to an element in the singular is not intended to mean one and one one" unless explicitly so stated, but rather "one or more". The inventions illustratively disclosed herein may be practiced without any element which is not specifically disclosed herein.

What is claimed is:

1. A device for monitoring grounding of equipment comprising:

an oscillator circuit that generates an alternating current control signal;

a connector that is connectable between the oscillator circuit and a piece of equipment to supply the alternating current control signal to the piece of equipment;

a signal level detector connected to the connector that detects the alternating current control signal wherein a magnitude of the alternating current control signal detected by the signal level detector is reduced if the piece of equipment is connected to ground; and a signal conditioning circuit connected between the connector and the signal level detector that rejects signals not related to the alternating current control signal.

2. The device of claim 1, wherein the signal conditioning circuit further comprises a filter.

3. The device of claim 2, wherein the filter further comprises a digital filter.

4. The device of claim 2, wherein the alternating current control signal has a frequency different from a frequency and harmonics of a power line.

5. The device of claim 4, wherein the alternating current control signal frequency is less than 50 Hz.

6. The device of claim 4, wherein the filter has a peak in a filter frequency response that corresponds to the alternating current control signal frequency and has one or more nulls in the filter frequency response that corresponds to the power line frequency and harmonics.

7. The device of claim 1, wherein the signal level detector further comprises a circuit that generates a signal as a function of the alternating current control signal that indicates an actual impedance of a connection between the piece of equipment and an external ground and wherein the magnitude of the generated signal indicates the magnitude of the ground impedance.

8. The device of claim 1 further comprising:

a high-pass filter with an input connected to the connector; and a second signal level detector circuit having an input connected to the output of the high-pass filter and an output connected to an alarm circuit, the alarm circuit indicating a high-frequency signal on a ground line connected to the piece of equipment.

9. The device of claim 8 further comprising a second alarm circuit that indicates that the ground line is properly connected to the piece of equipment.

10. The device of claim 8, wherein the signal level detector generates a signal, as a function of the strength of the high-frequency signal, that indicates an actual magnitude of the high-frequency signal.

11. A device for monitoring the grounding of a piece of equipment, comprising:

an alarm circuit, connectable to a piece of equipment, that generates an alarm signal when a piece of equipment is not properly connected to ground; and a switch connected to the alarm circuit that one of automatically enables and automatically disables the alarm circuit based on a need to monitor the piece of equipment so that a false alarm, when the piece of equipment is not connected to the monitoring device, is eliminated.

12. The device of claim 11, wherein the alarm circuit further comprises an indicator of a good ground connection of the piece of equipment, a second indicator of a bad ground connection of the piece of equipment and a third indicator of a disabled alarm circuit when the switch has disabled the alarm circuit.

13. The device of claim 11, wherein the alarm circuit further comprises an indicator of a good ground connection of the piece of equipment and a second indicator of a bad ground connection of the piece of equipment wherein there is no indication of a disabled alarm circuit.

14. A device for monitoring the grounding of a plurality of pieces of equipment, comprising:

an output circuit, connectable to a plurality of pieces of equipment, that generates an output signal on a single wire to a remote system having multiple signal levels indicating the ground connections of the plurality of pieces of equipment, wherein the level of the output signal is a function of the number of ground connections of the pieces of equipment.

15. The device of claim 14, wherein the level of the output signal is a function of a ground impedance for each piece of equipment.

16. A device for monitoring the grounding of an operator in an electrostatic discharge sensitive area, the device comprising:

a connector, connected to a dual wrist strap worn by an operator that is in electrical contact with the operator's body in plurality of separate places, the connector having a separate terminal for each connection to the body of the operator;

an oscillator circuit, connected to the connector, that generates an alternating current control signal that is capable of being supplied to the operator's body through the wrist strap when the wrist strap is connected to the connector; and a signal level detector circuit connected to the connector that measures a change in the alternating current control signal, based on an electrical resistance of the body of the operator, indicating that the operator is wearing a wrist strap connected to the connector.

17. The device of claim 16 further comprising a resistor, connected between the connector and a ground connection, that dissipates static charges from the operator.

18. The device of claim 16 further comprising a signal conditioning circuit, connected between the connector and the signal level detector circuit, that reject signals not related to the alternating current control signal.

19. The device of claim 18, wherein the signal conditioning circuit further comprises a filter.

20. The device of claim 19, wherein the filter further comprises a digital filter.

21. The device of claim 19, wherein the alternating current control signal has a frequency different from a frequency and harmonics of a power line.

22. The device of claim 21, wherein the alternating current control signal frequency is less than 50 Hz.

23. The device of claim 21, wherein the filter has a peak in a filter frequency response that corresponds to the alternating current control signal frequency and has one or more nulls in the filter frequency response that corresponds to the power line frequency and harmonics.

24. The device of claim 16, wherein the signal level detector circuit generates a signal that indicates an actual impedance of the body of the operator.

25. The device of claim 16 further comprising a direct current voltage level detector having an input connected to the connector and an output connected to an alarm circuit, wherein the direct current voltage detector generates a signal to the alarm circuit when a voltage on the operator exceeds a preset alarm level.

26. The device of claim 25 further comprising a second alarm circuit that indicates the connection of the operator to a wrist strap connected to the connector.

27. The device of claim 16 further comprising an output circuit that generates an output signal having multiple signal levels wherein the level of the output signal is a function of an impedance of the operator connected to the wrist strap.

28. A device for monitoring the grounding of an operator in an electrostatic discharge sensitive areas, the device comprising:

a connector, connected to a dual wrist strap worn by an operator that is in electrical contact with the operator's body in plurality of separate places, the connector having a first contact and a second contact capable of being connected to different portions of the wrist strap that contact different places of the body of the operator;

an oscillator circuit, connected to the first contact of the connector, that generates an alternating current control signal that is capable of being supplied to the operator's body through the first contact of the connector; and a signal level detector having an input connected to the second contact of the connector so that the alternating current control signal is passed through the body of the operator from the first contact to the second contact, wherein the signal level detector generates an output signal that indicates when the wrist strap is connected to the operator.

29. The device of claim 28 further comprising a resistor, connected between the connector and a ground path, that dissipates static charges from the operator.

30. The device of claim 28 further comprising a signal conditioning circuit, connected between the connector and the signal level detector circuit, that reject signals not related to the alternating current control signal.

31. The device of claim 30, wherein the signal conditioning circuit further comprises a filter.

32. The device of claim 31, wherein the filter further comprises a digital filter.

33. The device of claim 31, wherein the alternating current control signal has a frequency different from a frequency and harmonics of a power line.

34. The device of claim 33, wherein the alternating current control signal frequency is less than 50 Hz.

35. The device of claim 33, wherein the filter has a peak in a filter frequency response that corresponds to the alternating current control signal frequency and has one or more nulls in the filter frequency response that corresponds to the power line frequency and harmonics.

36. The device of claim 28, wherein the signal level detector circuit generates a signal that indicates an actual impedance of the body of the operator.

37. The device of claim 28 further comprising a direct current voltage level detector having an input connected to the connector and an output connected to an alarm circuit, wherein the direct current voltage detector generates a signal to the alarm circuit when a voltage on the operator exceeds a preset alarm level.

38. The device of claim 37 further comprising a second alarm circuit that indicates the connection of the operator to the wrist strap connected to the connector.

39. The device of claim 28 further comprising an output circuit that generates an output signal having multiple signal levels wherein the level of the output signal is a function of an impedance of the operator connected to the wrist strap.

40. A device for monitoring the grounding of an operator in an electrostatic discharge sensitive area, the device comprising:

a connector, connected to a dual wrist strap worn by an operator that is in electrical contact with the operator's body in plurality of separate places, the connector having a first contact and a second contact capable of being connected to different portions of the wrist strap that are connected to different places on the body of the operator;

an oscillator circuit having a first and second output, the first output connected to the first contact of the connector and the second output connected to the second contact of the connector, the oscillator circuit generating an alternating current control signal that is supplied to the operator's body through the first and second contacts of the connector; and a signal level detector having a first and second input, the first input connected to the first contact of the connector and the second input connected to the second contact of the connector, the signal level detector indicates a difference between the first and second inputs, wherein the signal level detector generates an output signal that indicates when the wrist strap connected to the connector is connected to the operator.

41. The device of claim 40 further comprising a resistor, connected between the connector and a ground path, that dissipates static charges from the operator.

42. The device of claim 40 further comprising a signal conditioning circuit, connected between the connector and the signal level detector, that reject signals not related to the alternating current control signal.

43. The device of claim 42, wherein the signal conditioning circuit further comprises a filter.

44. The device of claim 43, wherein the filter further comprises a digital filter.

45. The device of claim 43, wherein the alternating current control signal has a frequency different from a frequency and harmonics of a power line.

46. The device of claim 45, wherein the alternating current control signal frequency is less than 50 Hz.

47. The device of claim 43, wherein the filter has a peak in a filter frequency response that corresponds to the alternating current control signal frequency and has one or more nulls in the filter frequency response that corresponds to the power line frequency and harmonics.

48. The device of claim 40, wherein the signal level detector generates a signal that indicates an actual impedance of the body of the operator.

49. The device of claim 40 further comprising a direct current voltage level detector having an input connected to the connector and an output connected to an alarm circuit, wherein the direct current voltage detector generates a signal to the alarm circuit when a voltage on the operator exceeds a preset alarm level.

50. The device of claim 49 further comprising a second alarm circuit that indicates the operator being connected to the wrist strap connected to the connector.

51. The device of claim 40 further comprising an output circuit that generates an output signal having multiple signal levels wherein the level of the output signal is a function of an impedance of the operator connected to the wrist strap.

52. A device for monitoring the grounding of an operator in an electrostatic discharge sensitive area, the device comprising:

at least two connectors wherein a first connector is connected to a wrist strap of an operator and the grounding of the operator is monitored and a second connector is connected to a wrist strap of a visitor and the grounding of the visitor is not monitored; and a circuit that detects the presence of the first and second connectors wherein a connection to the second connector without any connection to the first connector generates an alarm and wherein the connection to the second connector after the connection to the first connector does not generate an alarm.

53. The device of claim 52 further comprising:

a signal source circuit connected to the first connector to provide a control signal to the operator through the first connector;

a signal level detecting circuit, connected to the first connector, that measures a magnitude of the control signal that has passed through the operator;

an alarm circuit connected to an output of the signal level detector circuit;

a first switching jack having first and second contacts and a second switching jack having first and second contacts wherein the first contact of first switching jack is connected to a first contact of the first connector, the second contact of first switching jack is connected to a first contact of the second connector and to the first contact of the second switching jack and the second contact of the second jack is connected to the second contact of first switching jack;

wherein, with no wrist strap is connected to either connector, the switching jacks provide a low-impedance circuit across the first connector thus providing a low control voltage to the signal level detecting circuit indicating an absence of a wrist strap plugged into either connector and, with a wrist strap connected to the second connector, the switching jacks providing an open circuit across the first connector thus providing a high level of control voltage; and wherein the alarm circuit indicates a failed connection to an operator when said control voltage across said first connector exceeds a predetermined value.

54. A method for monitoring the grounding of an object in an electrostatic discharge sensitive area, the method comprising:

generating an alternating current control signal;

applying the alternating current control signal to an object to be monitored;

monitoring a level of the alternating current control signal after being applied to the monitored object; and activating an alarm if the level of the alternating current control signal exceeds a preset alarm level.

55. The method of claim 54 further comprising filtering the alternating current control signal to remove signals not associated with the alternating current control signal prior to monitoring the level of the alternating current control signal.

56. The method of claim 55 where the filtering of the signal further comprises using a digital filter.

57. The method of claim 54, wherein generating the alternating current control signal further comprises generating an alternating current signal with a frequency that is different from a frequency and harmonics of a power line.

58. The method of claim 57, wherein the frequency of the alternating current is less than 50 Hz.

59. The method of claim 57, wherein the signal filtering further comprises using a filter having a peak in filter frequency response that corresponds to the alternating current control signal frequency and having one or more nulls in filter frequency response that corresponds to the frequency and harmonics of the power line.

60. A method for monitoring the grounding of an operator in an electrostatic discharge sensitive area, the monitoring device having a first connector for an operator whose grounding is monitored and a second connector for a visitor whose grounding is not monitored, the method comprising:

detecting a connection to a connector that is not monitored for grounding; and generating an alarm when no connection is detected for a second connector that is being monitored for grounding.

61. A method for monitoring the grounding of a user, comprising:

generating an alternating current voltage that is applied to the user;

monitoring the grounding of the user based on a decrease in the alternating current voltage caused by the resistance of the user; and monitoring a magnitude of the alternating current voltage applied to the user; and generating an alarm if the magnitude of the alternating current voltage exceeds a preset level.

62. A device for monitoring the grounding of a user based on an alternating current voltage, comprising:

a circuit that measures a decrease in the alternating current voltage caused by the resistance of a user to determine if the user is properly grounded;

a circuit that monitors a magnitude of the alternating current voltage applied to the user and generates an alarm if the magnitude of the alternating current voltage exceeds a preset level.

* * * * *